US011814966B2

(12) United States Patent
Chuong et al.

(10) Patent No.: US 11,814,966 B2
(45) Date of Patent: Nov. 14, 2023

(54) RETENTION RING WITH REMOVAL FEATURES FOR GAS TURBINE ENGINE

(71) Applicant: RAYTHEON TECHNOLOGIES CORPORATION, Farmington, CT (US)

(72) Inventors: Conway Chuong, Manchester, CT (US); Caroline A. Karanian, West Hartford, CT (US); Joey Wong, Enfield, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/700,682

(22) Filed: Mar. 22, 2022

(65) Prior Publication Data

US 2023/0304413 A1 Sep. 28, 2023

(51) Int. Cl.
*F01D 11/00* (2006.01)

(52) U.S. Cl.
CPC ..... *F01D 11/003* (2013.01); *F05D 2220/32* (2013.01); *F05D 2230/60* (2013.01); *F05D 2240/55* (2013.01)

(58) Field of Classification Search
CPC ..... F01D 11/00; F01D 11/003; F01D 11/02; F05D 2230/60; F05D 2230/70; F05D 2260/30; F05D 2220/32; F05D 2240/55; F16J 15/44; F16J 15/441; F16J 15/442; F16J 15/443; F16J 15/444; F16J 15/445; F16J 15/447; F16J 15/4472
See application file for complete search history.

(56) References Cited

U.S. PATENT DOCUMENTS

| | | | | |
|---|---|---|---|---|
| 4,859,143 | A | 8/1989 | Larrabee et al. | |
| 2013/0323052 | A1 | 12/2013 | Zhang et al. | |
| 2018/0363484 | A1* | 12/2018 | Miller | F01D 25/162 |
| 2019/0017605 | A1* | 1/2019 | Miller | F01D 25/186 |
| 2020/0032668 | A1* | 1/2020 | Garrison | F16J 15/24 |
| 2020/0300122 | A1 | 9/2020 | Anglin et al. | |

OTHER PUBLICATIONS

Extended European Search Report for EP Application No. 23152761.5 dated Jun. 29, 2023.

* cited by examiner

*Primary Examiner* — Elton K Wong
(74) *Attorney, Agent, or Firm* — Carlson, Gaskey & Olds, P.C.

(57) ABSTRACT

A retention ring for a gas turbine engine according to an example of the present disclosure includes, among other things, a main body extending in a circumferential direction about an axis to establish a continuous hoop having a first diameter and a second diameter. The main body includes first and second circumferential faces along opposite sides of the main body. The first circumferential face is dimensioned to abut a gas turbine engine component. The main body includes at least one removal feature dimensioned to sever in response to engagement with a cutting tool. A method of assembly is also disclosed.

20 Claims, 6 Drawing Sheets

RETENTION RING WITH REMOVAL FEATURES FOR GAS TURBINE ENGINE

STATEMENT REGARDING FEDERALLY SPONSORED RESEARCH OR DEVELOPMENT

This invention was made with government support awarded by the United States. The Government has certain rights in this invention.

BACKGROUND

This disclosure relates to retention of gas turbine engine components.

A gas turbine engine typically includes at least a compressor section, a combustor section and a turbine section. The compressor section pressurizes air into the combustion section where the air is mixed with fuel and ignited to generate an exhaust gas flow. The exhaust gas flow expands through the turbine section to drive the compressor section and, if the engine is designed for propulsion, a fan section.

One or more components can be releasably secured in the engine, such as a seal that establishes a sealing relationship with an adjacent component such as a rotatable shaft. The seal may be secured to a housing with a split ring.

SUMMARY

A retention ring for a gas turbine engine according to an example of the present disclosure includes a main body extending in a circumferential direction about an axis to establish a continuous hoop having a first diameter and a second diameter. The main body includes first and second circumferential faces along opposite sides of the main body that extend in a radial direction between the first and second diameters. The first circumferential face is dimensioned to abut a gas turbine engine component. The main body includes at least one removal feature dimensioned to sever in response to engagement with a cutting tool. The removal feature includes a notch and a first groove. The notch extends in an axial direction along a face of the second diameter between the first and second circumferential faces. The first groove extends in the radial direction from a floor of the notch along the first circumferential face to a face of the first diameter.

In a further embodiment of any of the foregoing embodiments, the at least one removal feature includes a plurality of removal features distributed about the axis.

In a further embodiment of any of the foregoing embodiments, the first diameter is an inner diameter of the continuous hoop, and the second diameter is an outer diameter of the continuous hoop.

In a further embodiment of any of the foregoing embodiments, the at least one removal feature includes a second groove extending in the radial direction from the floor of the notch along the second circumferential face to the face of the second diameter.

In a further embodiment of any of the foregoing embodiments, the first groove is aligned with the second groove relative to the circumferential direction.

In a further embodiment of any of the foregoing embodiments, a first width of the first groove at the floor of the notch is less than a maximum width of the notch, the first width and the maximum width relative to the circumferential direction. A first length of the first groove is greater than a maximum height of the notch, the first length and the maximum height relative to the radial direction.

In a further embodiment of any of the foregoing embodiments, the main body comprises a metallic material.

A gas turbine engine according to an example of the present disclosure includes a support extending about an engine longitudinal axis. The support includes a shoulder and a retention slot. The gas turbine engine includes a gas turbine engine component and a retention ring received in the retention slot. The retention ring includes a main body having a first diameter and a second diameter. The main body includes first and second circumferential faces along opposite sides of the main body. The first circumferential face is dimensioned to abut the gas turbine engine component. The main body includes at least one removal feature. The at least one removal feature includes a notch and a first groove. The notch extends inwardly from a face of the second diameter that is received in the retention slot. The first groove extends radially from a floor of the notch along the first circumferential face. The floor of the notch is radially offset from the retention slot relative to the engine longitudinal axis to establish a clearance gap. The clearance gap is dimensioned to receive a cutting tool movable along the first groove to sever the retention ring.

In a further embodiment of any of the foregoing embodiments, the main body extends circumferentially about the engine longitudinal axis to establish a continuous hoop.

In a further embodiment of any of the foregoing embodiments, the first diameter is an inner diameter of the retention ring, the second diameter is an outer diameter of the retention ring, and the groove extends from the notch to the inner diameter of the retention ring.

In a further embodiment of any of the foregoing embodiments, the shoulder and the retention slot extend circumferentially about the engine longitudinal axis. The retention slot is radially outward of the shoulder. The gas turbine engine component extends radially inward of the first circumferential face of the main body.

In a further embodiment of any of the foregoing embodiments, the at least one removal feature includes a plurality of removal features circumferentially distributed about an axis of the retention ring.

In a further embodiment of any of the foregoing embodiments, the gas turbine engine component is an annular seal dimensioned to engage a rotatable component.

A method of assembly for a gas turbine engine according to an example of the present disclosure includes changing a temperature of at least one of a retention ring and a support to meet a respective predetermined temperature threshold when the retention ring is in a first position to establish an assembly clearance when the retention ring is in a second position relative to the support. The assembly clearance is established between a second diameter of the retention ring and a retention slot of the support. The retention ring includes a main body establishing a continuous hoop including a first diameter and the second diameter. The main body includes at least one removal feature having a notch and a first groove. The notch extends along the second diameter of the retention ring. The first groove extends along a first circumferential face of the main body to the first diameter of the retention ring. The method includes moving a gas turbine engine component along an assembly axis such that the gas turbine engine component is adjacent to a shoulder of the support, moving the retention ring along the assembly axis from the first position to the second position to establish the assembly clearance such that the retention ring is axially aligned with, but is spaced apart from, the retention slot, and reducing the assembly clearance in response to the temperature no longer meeting the respective predetermined temperature threshold. The reducing step occurs such that the second diameter of the retention ring is captured in the retention slot, such that the gas turbine engine component is trapped between the shoulder of the support and the first circumferential face of the retention ring, and such that a clearance gap is established between the support and a floor of the notch.

In a further embodiment of any of the foregoing embodiments, the at least one removal feature includes a plurality of removal features circumferentially distributed along the first circumferential face.

A further embodiment of any of the foregoing embodiments, the method includes severing the retention ring in response to moving a cutting tool into the clearance gap and then along the first groove, and removing at least one portion of the severed retention ring from the retention slot, and then removing the gas turbine engine component from the support.

In a further embodiment of any of the foregoing embodiments, a maximum height of the notch is greater than a maximum height of the retention slot at a common circumferential position relative to an engine longitudinal axis.

In a further embodiment of any of the foregoing embodiments, the at least one removal feature includes a second groove extending from the notch. The notch interconnects the first and second grooves. The second groove extends along a second circumferential face of the retention body such that the second groove is circumferentially aligned with the first groove. The severing step includes moving the cutting tool along a cutting path intersecting both the first and second grooves to establish a pathway between the first and second grooves.

In a further embodiment of any of the foregoing embodiments, the second diameter of the retention ring is an outer diameter. The retention slot is established along a radially inward facing surface of the support relative to the assembly axis. The assembly clearance is established between the outer diameter of the retention ring and the radially inward facing surface of the support. The respective predetermined temperature threshold includes a first predetermined temperature threshold associated with the support and a second predetermined temperature threshold associated with the retention ring. The step of changing the temperature includes heating the support above the first predetermined temperature threshold to cause the retention slot of the support to expand relative to the assembly axis, and cooling the retention ring below the second predetermined threshold to cause the outer diameter of the retention ring to contract relative to the assembly axis, the second predetermined threshold being less than the first predetermined threshold.

In a further embodiment of any of the foregoing embodiments, the support comprises a first metallic material, and the main body comprises a second metallic material.

The present disclosure may include any one or more of the individual features disclosed above and/or below alone or in any combination thereof.

The various features and advantages of this invention will become apparent to those skilled in the art from the following detailed description of an embodiment. The drawings that accompany the detailed description can be briefly described as follows.

DETAILED DESCRIPTION

Figure 1:
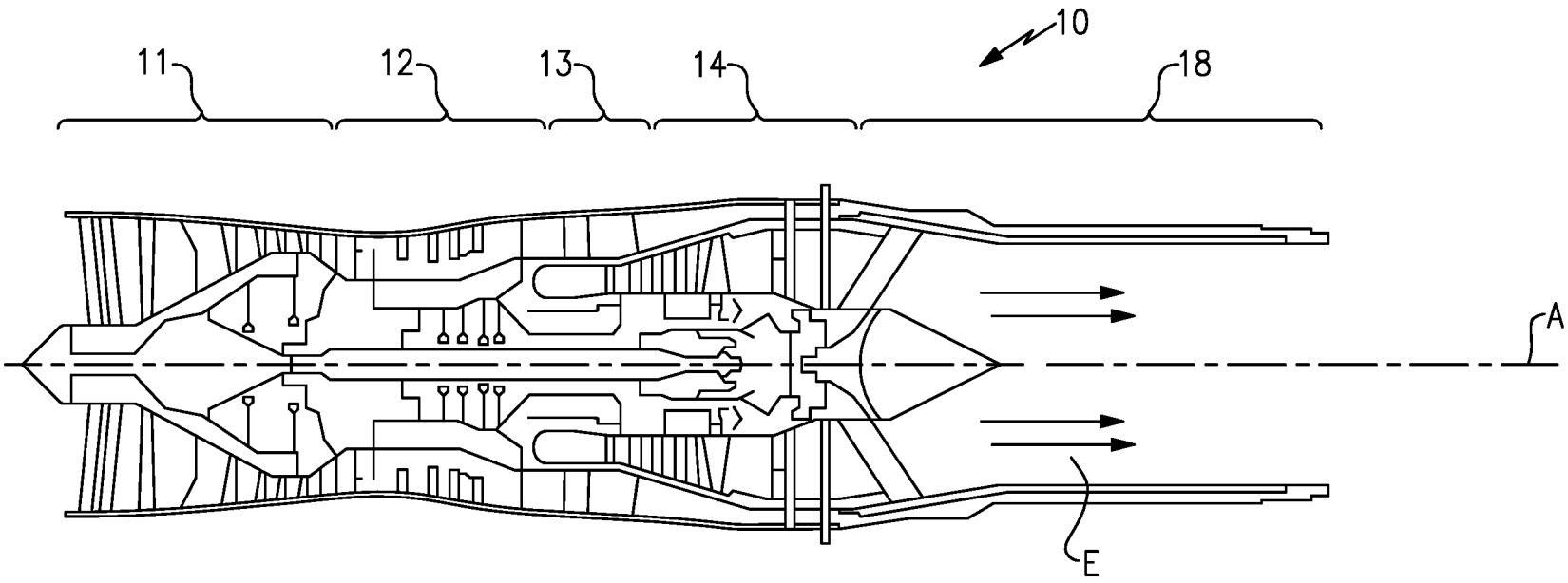
FIG. 1 shows an example gas turbine engine.

Referring to FIG. 1, a gas turbine engine 10 includes a fan section 11, a compressor section 12, a combustor section 13, and a turbine section 14. Air entering into the fan section 11 is initially compressed and fed to the compressor section 12. In the compressor section 12, the incoming air from the fan section 11 is further compressed and communicated to the combustor section 13. In the combustor section 13, the compressed air is mixed with gas and ignited to generate a hot exhaust stream E. The hot exhaust stream E is expanded through the turbine section 14 to drive the fan section 11 and the compressor section 12. The exhaust gasses E flow from the turbine section 14 through an exhaust liner assembly 18.

Figure 2:
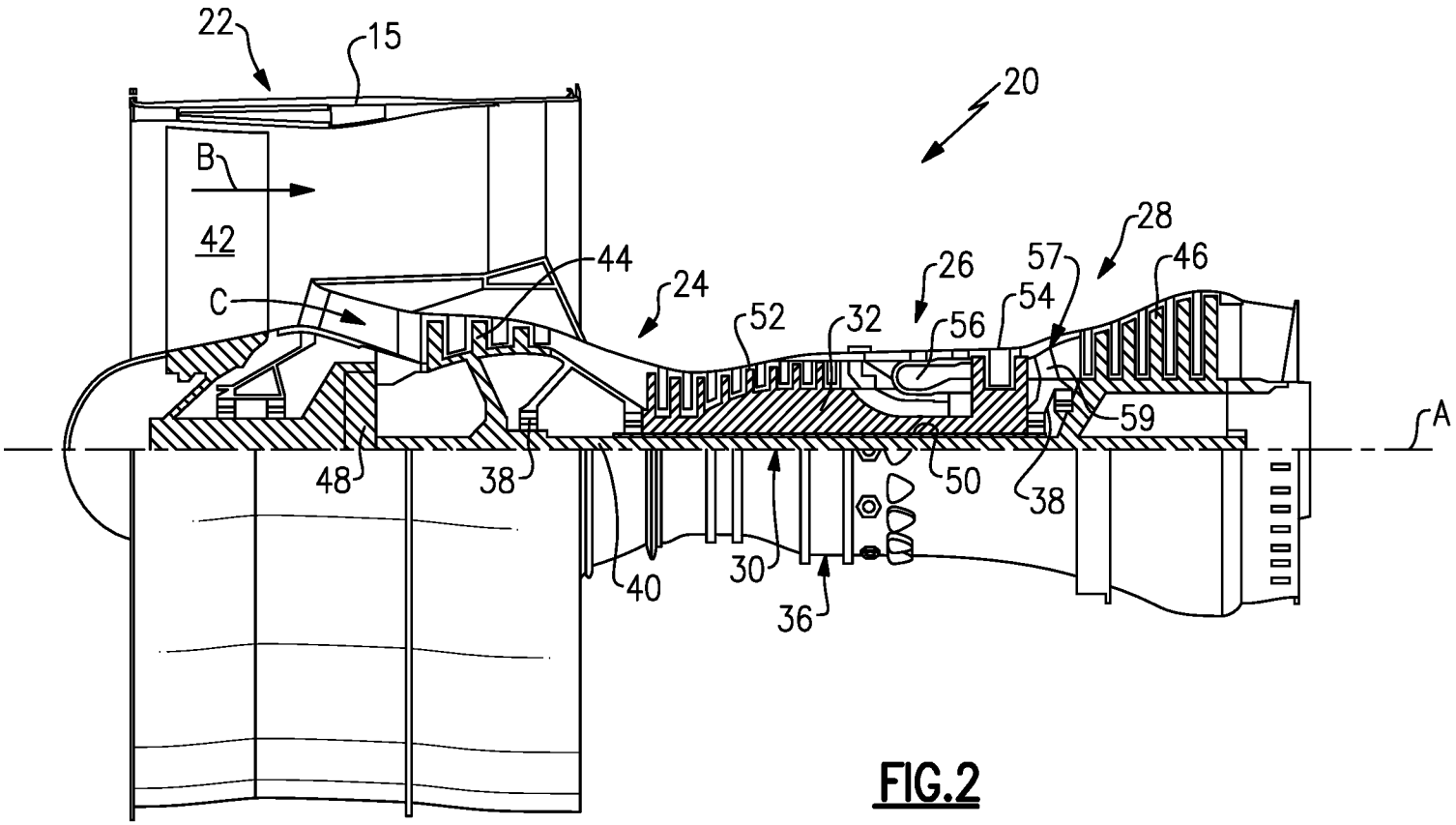
FIG. 2 illustrates another example gas turbine engine.

FIG. 2 schematically illustrates a gas turbine engine 20 according to another example. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), and can be less than or equal to about 18.0, or more narrowly can be less than or equal to 16.0. The geared architecture 48 is an epicyclic gear train, such as a planetary gear system or other gear system, with a gear reduction ratio of greater than about 2.3. The gear reduction ratio may be less than or equal to 4.0. The low pressure turbine 46 has a pressure ratio that is greater than about five. The low pressure turbine pressure ratio can be less than or equal to 13.0, or more narrowly less than or equal to 12.0. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to an inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above and those in this paragraph are measured at this condition unless otherwise specified. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45, or more narrowly greater than or equal to 1.25. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150.0 ft/second (350.5 meters/second), and can be greater than or equal to 1000.0 ft/second (304.8 meters/second).

Figure 3:
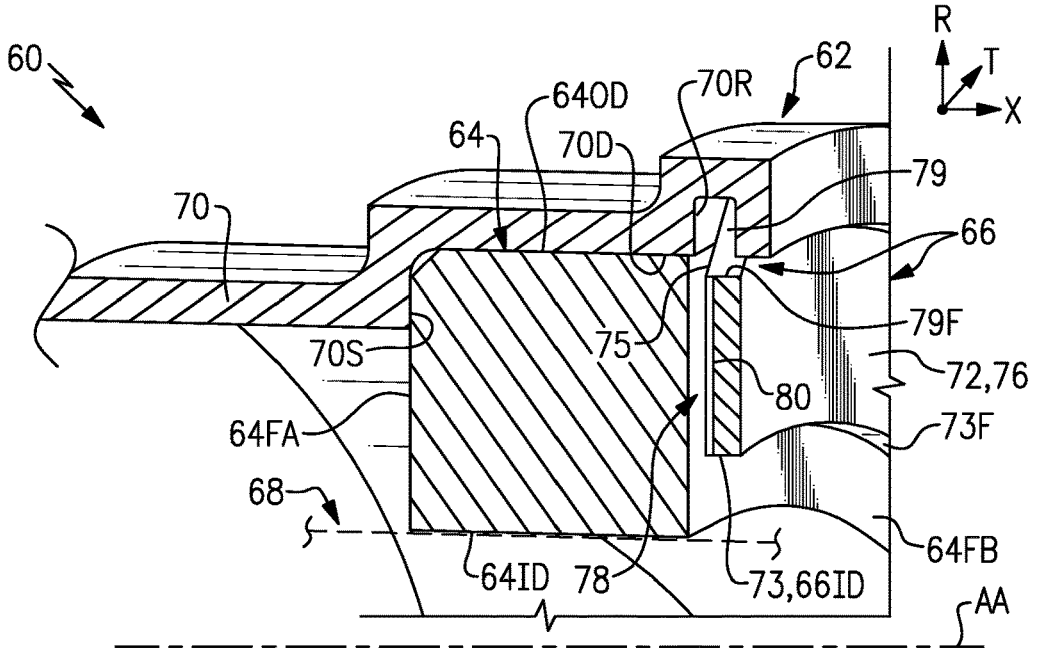
FIG. 3 illustrates a perspective view of an exemplary assembly in a cold assembly state including a retention ring.

FIG. 3 illustrates an exemplary assembly 60 for a gas turbine engine. The assembly 60 can include one or more retention features for securing and removing gas turbine engine component(s) in a gas turbine engine, such as the gas turbine engine 10 of FIG. 1 or the gas turbine engine 20 of FIG. 2. Although the assembly 60 is primarily discussed in relation to a gas turbine engine including a fan, other systems can benefit from the teachings disclosed herein including a gas turbine engine lacking a fan for propulsion.

The assembly 60 can include a first gas turbine engine component 62, a second gas turbine engine component 64 and a retention ring 66. The retention ring 66 can be arranged to secure the first and second components 62, 64 to the each other. The first and second components 62, 64 and retention ring 66 can be static or rotatable components. The first component 62 can be a support (e.g., static support piece) such as a housing or another portion of a static structure, such as the engine static structure 36 (FIG. 2). The second component 64 (e.g., retained engine hardware) can be an annular seal dimensioned to engage a third gas turbine engine component 68 in a cold assembly state (shown in dashed lines for illustrative purposes). The third component 68 can be a rotatable component such as a rotatable shaft, including one of the shafts 40, 50 (FIG. 2). The second and third components 64, 68 can cooperate to establish a sealing relationship.

The first and second components 62, 64 and retention ring 66 can extend along an assembly axis AA. The first and second components 62, 64 and/or retention ring 66 can have a generally annular geometry and can extend in a circumferential direction T about the assembly axis AA. The assembly axis AA can be substantially collinear or otherwise parallel with the engine longitudinal axis A of the engines 10, 20. For the purposes of this disclosure, the terms "substantially," "about" and "approximately" mean±5 percent of the stated value or relationship unless otherwise indicated.

The first component 62 can include a main body 70 including a shoulder 70S and a retention slot 70R. The shoulder 70S and retention slot 70R can be spaced apart in an axial direction X relative to the assembly axis AA. The shoulder 70S can be a circumferential face dimensioned to abut against a first circumferential face 64FA of the second component 64. The retention slot 70R can be an annular groove extending along a first (e.g., inner) diameter 70D of the first component 62. The shoulder 70S and the retention slot 70R can extend in a circumferential direction T about the engine longitudinal axis A and/or assembly axis AA.

The shoulder 70S can extend radially inward from the first diameter 70D of the first component 62 such that the retention slot 70R and shoulder 70S are radially offset in a radial direction R relative to the assembly axis AA. The retention slot 70R can be radially outward of the shoulder 70S. The retention slot 70R can extend radially outward from the first diameter 70D of the first component 62 relative to the assembly axis AA.

The retention ring 66 is dimensioned to be at least partially received in the retention slot 70R in the cold assembly state. A portion of the retention ring 66 can be dimensioned to extend outwardly of the retention slot 70R to engage another gas turbine component, such as the second component 64. The retention ring 66 can be dimensioned to abut a second circumferential face 64FB of the second component 64 in the installed position to trap or otherwise secure the second component 64 between the shoulder 70S and the retention ring 66. The first and second circumferential faces 64FA, 64FB can be established along opposite sides of the second component 64. The second component 64 can include an inner (e.g., first) diameter 64ID and outer (e.g., second) diameter 640D. The first and second circumferential faces 64FA, 64FB can be dimensioned to extend in the radial direction R between the inner and outer diameters 64ID, 640D of the second component 64 (also shown in dashed lines in FIG. 4). The inner diameter 64ID of the second component 64 can be dimensioned to engage the third component 68 to establish a sealing relationship.

Figure 4:
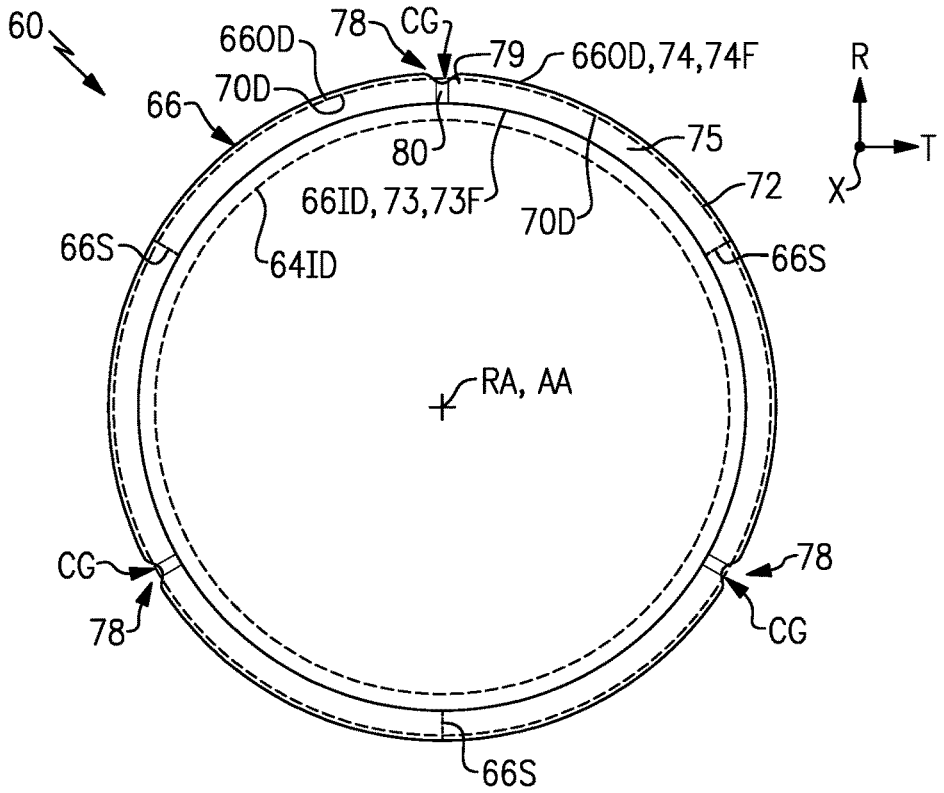
FIG. 4 illustrates an axial view of the retention ring in the assembly of FIG. 3.

The retention ring 66 can include a main body 72 dimensioned to engage and secure a gas turbine engine component, such as the second component 64. The main body 72 can have various geometries, such as a substantially circular or elliptical geometry. The main body 72 can extend in the circumferential direction T about a ring axis RA. The ring axis RA can be substantially collinear or otherwise parallel to the assembly axis AA. The main body 72 can extend in the circumferential direction T about the ring axis RA to establish a continuous hoop having a first diameter 73 and a second diameter 74, as illustrated in FIG. 4. The first diameter 73 and second diameter 74 can be established on opposite sides of the main body 72. The first diameter 73 can be an inner diameter 66ID of the continuous hoop, and the second diameter 74 can be an outer diameter 660D of the continuous hoop, as illustrated by FIG. 4, although an opposite arrangement can be utilized in accordance with the teachings disclosed herein. The retention ring 66 can be a unitary component. The main body 72 can extend circumferentially about the engine longitudinal axis A of the engine 10, 20 to establish the continuous hoop. For the purposes of this disclosure, the term "continuous hoop" means a ring structure lacking any circumferential ends. The continuous hoop can be utilized to improve stiffness of the retention ring 66 and reduce liberation of the retention ring 66 that may otherwise be caused by vibration, cracking, droop, deformation or other movement and changes to the retention ring 66 during engine operation. In other examples, the retention ring 66 can include one or more separate and distinct components permanently attached or otherwise fixedly secured to each other, as illustrated by sections 66S (shown in dashed lines in FIG. 4 for illustrative purposes).

The main body 72 includes a first circumferential face 75 and a second circumferential face 76 that extend in the circumferential direction T along opposite sides of the main body 72. Each of the first and second circumferential faces 75, 76 extend in the radial direction R between the first and second diameters 73, 74. The axial, circumferential and radial directions X, T, R can be established relative to the ring axis RA, assembly axis AA and/or engine axis A. The first circumferential face 75 is dimensioned to abut a gas turbine engine component in the cold assembly state, such as the second component 64. The second component 64 can be dimensioned to extend radially inward of the first and/or second circumferential faces 75, 76 and first and/or second diameters 73, 74 of the main body 70 in the assembly state, as illustrated by the inner diameter 641D of the second component 64 in FIGS. 3 and 4.

Various materials may be utilized to construct the components 62, 64 and retention ring 66. Each component 62, 64 and retention ring 66 can be formed of a material having a high temperature capability, including metallic and/or non-metallic materials. Example metallic materials include metals and alloys, such as nickel-based superalloys, titanium and steel. Example non-metallic materials include ceramic-based materials such as monolithic ceramics and ceramic matrix composites (CMC). Monolithic ceramics can include silicon carbide (SiC) and silicon nitride ($Si_3N_4$) materials. The main body 72 of the retention ring 66 can comprise a metallic and/or non-metallic material, including any of the materials disclosed herein.

The retention ring 66 can include one or more removal features 78 that may be utilized to remove the retention ring 66 from the first component 62 when in the assembled position, including when the retention ring 66 is captured in the retention slot 70R in the cold assembly state of the assembly 60. The main body 70 of the retention ring 66 can include at least one or more of the removal features 78. The retention ring 66 can include two or more removal features 78 circumferentially distributed about the ring axis RA, such as a total of three removal features 78, as illustrated in FIG. 4, although fewer or more than three removal features 78 can be utilized. The removal features 78 can be circumferentially distributed along the first and/or circumferential faces 75, 76 of the retention ring 66.

Each removal feature 78 can be dimensioned to sever for removal of the retention ring 66 and second component 64 in the cold assembly state. Each removal feature 78 can be dimensioned to sever in response to engagement with an instrument such as a cutting tool TT, as illustrated by the severed removal feature 78' of FIG. 6. The cutting tool TT can be a milling tool or a saw blade. Other arrangements can be utilized to establish the removal feature 78. In implementations, the removal feature 78 is a frangible connection that can be snapped or otherwise severed with a tool (e.g., plyers). The removal features 78 can be formed with the main body 72 of the retention ring 66 or may be formed in the retention ring 66 by a subsequent machining operation.

Figure 5:
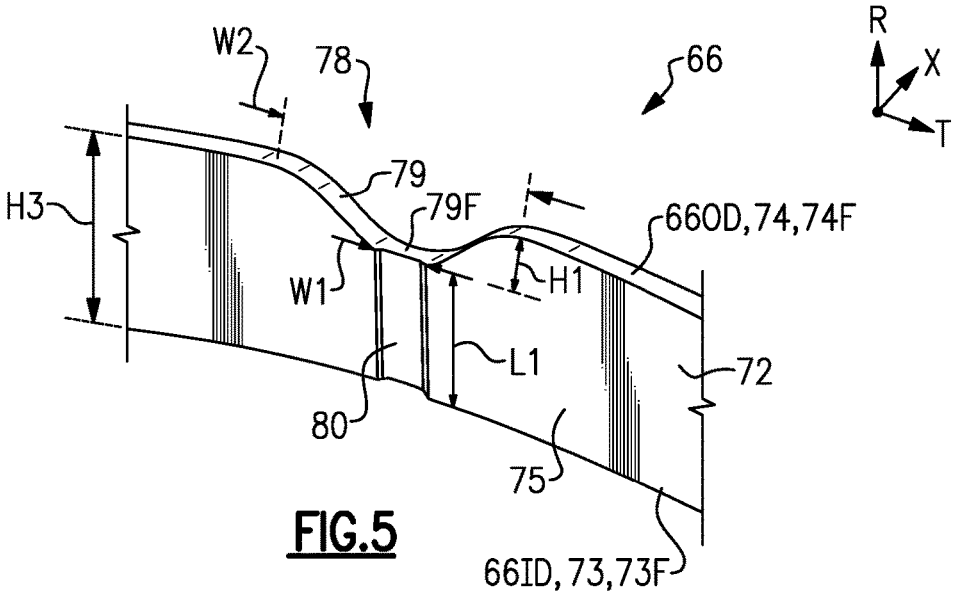
FIG. 5 illustrates an isolated perspective view of a portion of the retention ring of FIG. 4.

Each removal feature 78 can include a notch 79 and a first groove (e.g., trench) 80 joined with the notch 79. The notch 79 can extend in the axial direction X along a face 74F of the second diameter 74 between the first and second circumferential faces 75, 76, as illustrated in FIGS. 4 and 5. The notch 79 can extend inwardly from the face 74F of the second diameter 74 received in the retention slot 70R. The first groove 80 can extend in the radial direction R from a floor 79F of the notch 79 along the first circumferential face 75 to a face 73F of the first diameter 73, as illustrated in FIG. 5, although the opposite arrangement can be utilized such that the notch 79 extends along the face 73F of the first diameter 73.

Figure 7:
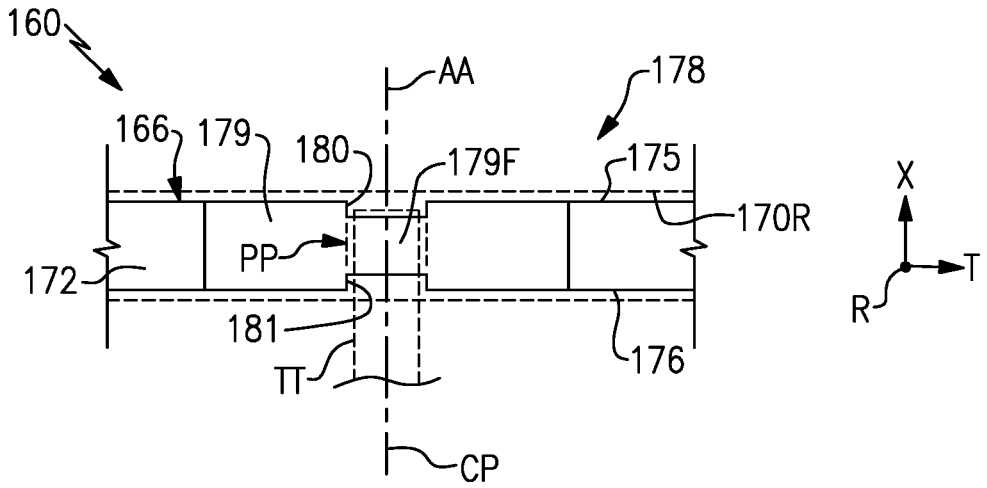
FIG. 7 illustrates a plan view of another exemplary retention ring.

In the example of FIG. 7, the removal feature 178 includes a notch 179 that joins a first groove 180 and a second groove 181 extending along opposite sides of the main body 172. The notch 179 and first and second grooves 180, 181 can incorporate any of the dimensions of the notch 79 and groove 80 of FIGS. 3-5. Each of the first and second grooves 180, 181 extend from the notch 179 such that the notch 179 interconnects the first and second grooves 180, 181. The first groove 180 can be dimensioned to extend along the first circumferential face 175. The second groove 181 can be dimensioned to extend along the second circumferential face 176. The first and second grooves 180, 181 can extend in the radial direction R from the floor 179F of the notch 179 along the respective first and second circumferential faces 180, 181 to the face of the second diameter of the retention ring 166 (e.g., face 74F of diameter 74 of FIG. 4). The first groove 180 can be circumferentially aligned with the second groove 181 relative to the circumferential direction T. Incorporating the first and second grooves 180, 181 can provide a mistake-proofing feature that facilities installation of the retention ring 66.

Referring back to FIGS. 3-5, the removal feature 78 can have various geometries to facilitate severing the retention ring 66. The notch 79 can be a scallop along the first or second diameters 73, 74 of the main body 70. Opposed sidewalls of the notch 79 can be dimensioned to slope inwardly from the face 74F of the second diameter 74 to the floor 79F of the notch 79. The sloping surfaces can be established by fillets or bevels, for example.

The removal feature 78 can have various dimensions to facilitate severing the retention ring 66. Referring to FIG. 5, with continuing reference to FIGS. 3-4, the first groove 80 can establish a first width W1 at the floor 79F of the notch 79. The notch 79 can establish a second width W2 along the one of the first and second faces 73F, 74F, such as along the face 74F of the second diameter 74. The second width W2 can be a maximum width of the notch 79, which can be established along one of the first and second faces 73F, 74F, such as along the second face 74F of the second diameter 74. The first and second widths W1, W2 can be defined relative to the circumferential direction T. The removal feature 78 can be dimensioned such that the first width W1 is less than the second width W2 of the notch 79. The removal feature 78 can be dimensioned such that the ratio W1:W2 is less than about 1:2, or more narrowly between about 1:3 and about 1:5.

The first groove 80 can establish a first length L1 between the floor 79F of the notch 79 and the face 73F of the first diameter 73. The notch 79 can establish a first height H1. The first height H1 can be a maximum height of the notch 79 between the floor 79F of the notch 79 and the face 74F of the second diameter 74. The first length L1 and first height H1 can be defined relative to the radial direction R and can be defined at a common circumferential position along the first groove 80. The removal feature 78 can be dimensioned such that the first length L1 is greater than the first height H1 of the notch 79. The removal feature 78 can be dimensioned such that the ratio L1:H1 is greater than about 2:1, or more narrowly between about 3:1 and about 5:1. The maximum height of the notch 79 can be greater than or equal to about 5 percent of a height H3 of the main body 70 of the retention ring 66 at a common circumferential position between the first and second diameters 73, 74 relative to the radial direction R, or more narrowly less than or equal to about 50 percent of the height H3 of the main body 70. The maximum height of the notch 79 can be greater than a maximum height H2 of the retention slot 70R (FIG. 9) at a common circumferential position relative to the assembly axis AA and/or engine axis A (FIGS. 1 and 2). The removal feature 78 can be dimensioned such that the ratio H1:H2 is greater than about 0.5:1, or more narrowly greater than about 0.8:1.

Figure 6:
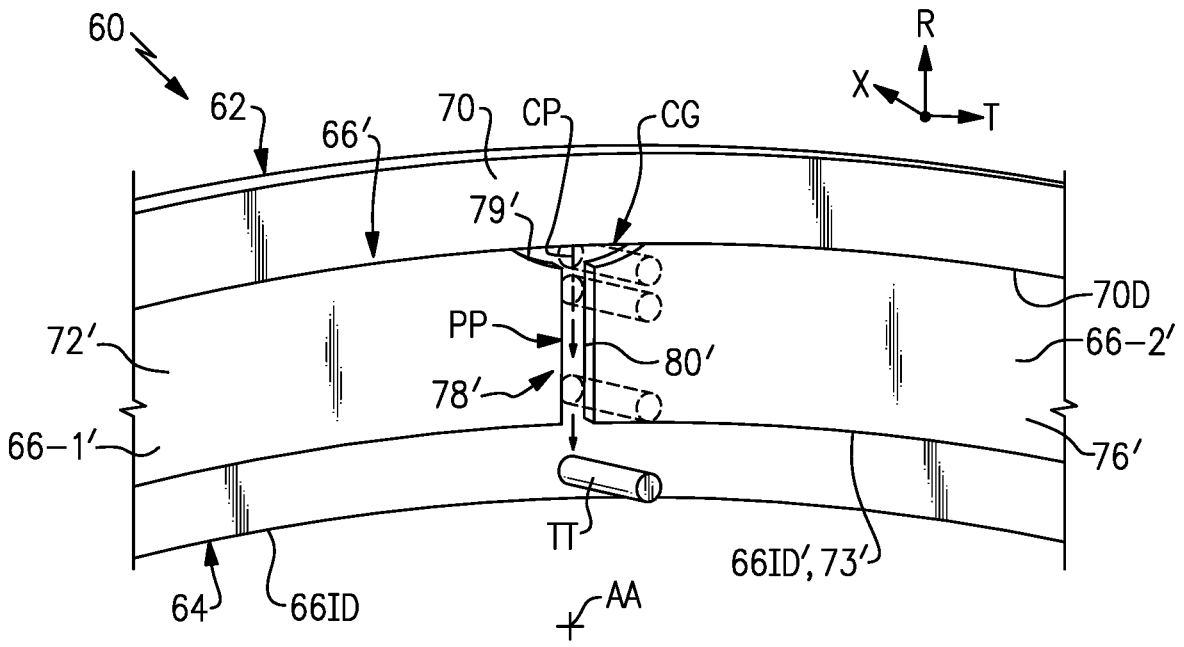
FIG. 6 illustrates a perspective view of the assembly of FIG. 3 including engagement of the retention ring with a tool.

The removal features 78 can be dimensioned relative to the first component 62 to facilitate removal of the retention ring 66 from the slot 70R. Each of the removal features 78 can be dimensioned such that the floor 79F of the notch 79 is radially offset from the retention slot 70R relative to the engine and/or assembly axis A, AA to establish a respective clearance gap CG, as illustrated in FIGS. 3-4 and 6. An array of the clearance gaps CG can be established circumferentially about the assembly axis AA. Each clearance gap CG can be localized such that the clearance gaps CG are spaced apart from each other relative to the circumferential direction T. The notches 79 can be dimensioned such that each clearance gap CG extends no more than 10 degrees about the assembly axis AA, or more narrowly no more than 5 degrees about the assembly axis AA, which can improve rigidity of the retention ring 66.

Each clearance gap CG can be dimensioned to receive a cutting tool TT, as illustrated in FIG. 6. The cutting tool TT can be movable along a cutting path CP (shown in dashed lines for illustrative purposes). The cutting path CP can be established along a length of the first groove 80 and can intersect the notch 79. The cutting tool TT can be movable along the first groove 80 to sever the retention ring 66, as illustrated by the retention ring 66' of FIG. 6. The retention ring 66' can be severed into two or more portions, as illustrated by portions 66-1', 66-2'. Each of the portions 66-1', 66-2' of the severed retention ring 66' can be removed from the retention slot 70R when in the cold assembly state. A depth of the groove 80 can be dimensioned to facilitate movement of the cutting tool TT along the cutting path CP while spacing apart the cutting tool TT from the second component 64, which can reduce a likelihood of degradation of the second component 64 during the severing operation.

Figure 8:
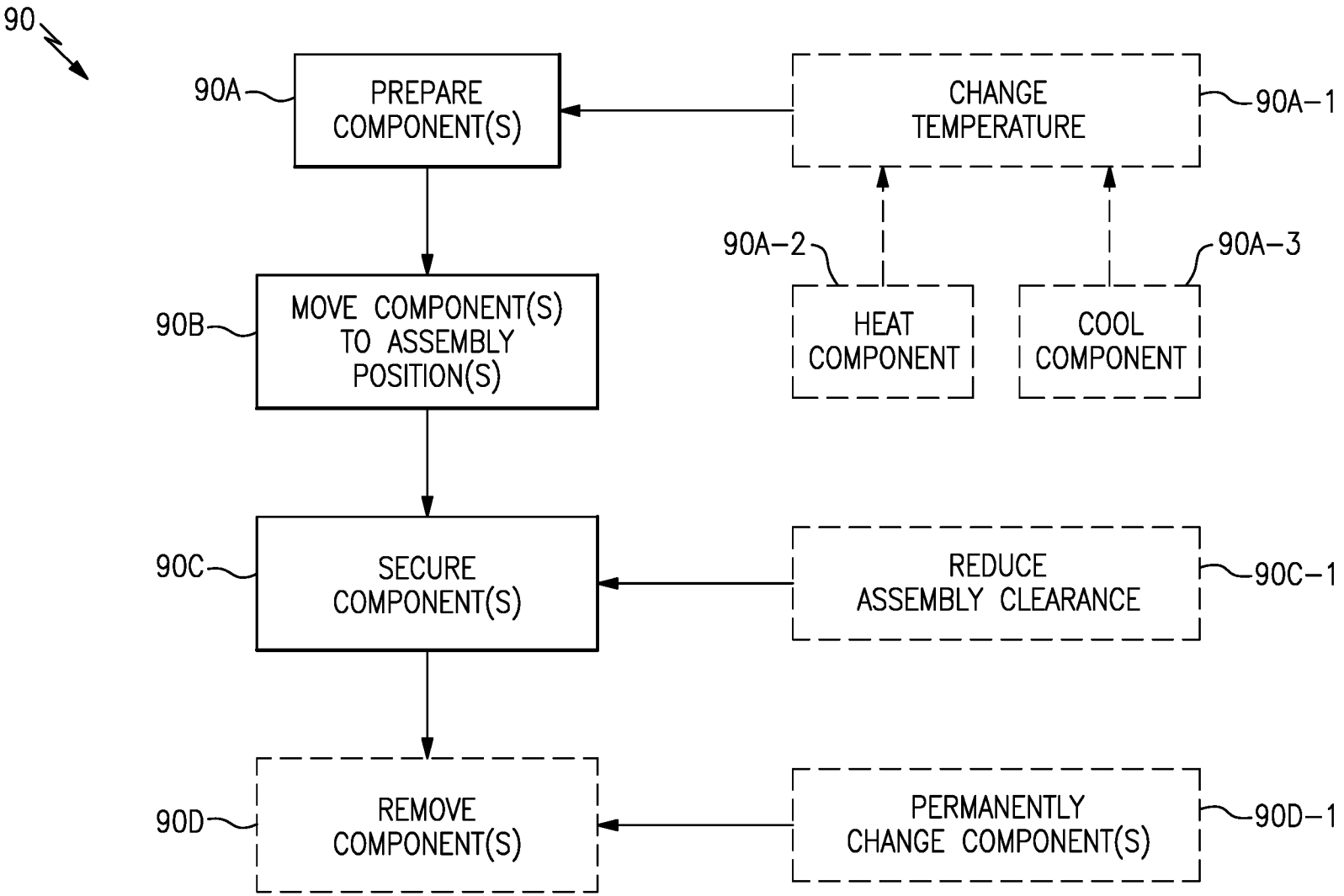
FIG. 8 illustrates a method of assembly for a gas turbine engine.

FIG. 8 illustrates an exemplary method of assembly for a gas turbine engine in a flow chart 90. The method 90 can be utilized to assemble, retain and disassemble various components of a gas turbine engine, including any of the components disclosed. Reference is made to the assembly 60 for illustrative purposes.

Figure 9:
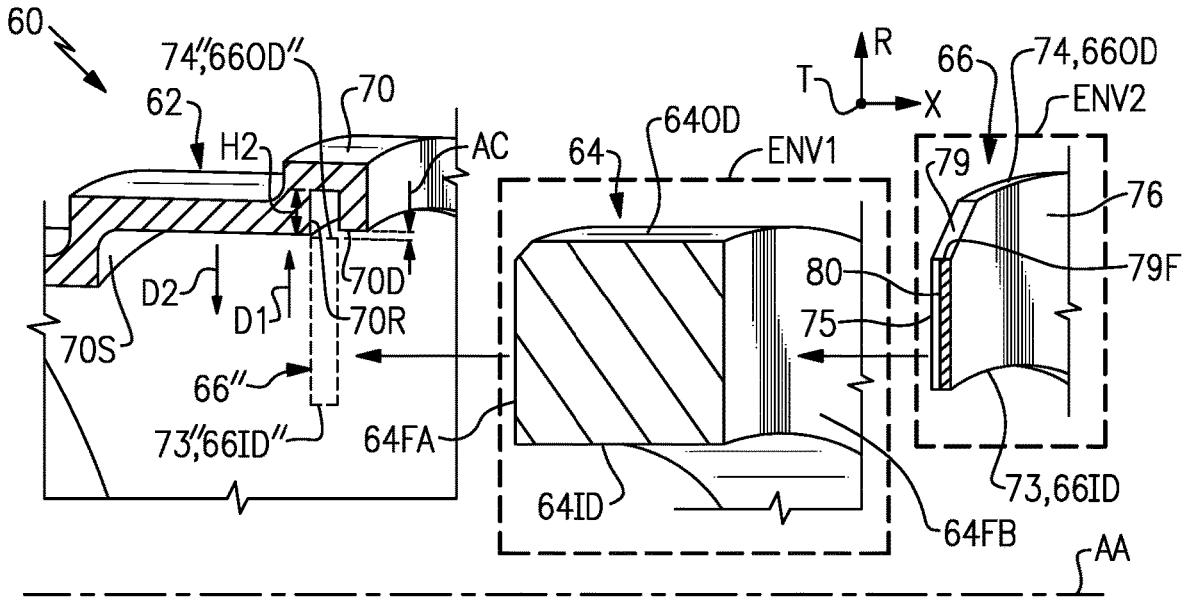
FIG. 9 illustrates components of the assembly of FIG. 3 in an uninstalled state.

Referring to FIG. 9, with continuing reference to FIG. 8, one or more components of the assembly 60 are prepared for assembly or installation at step 90A, such as the first component 62 and/or retention ring 66. Preparing the components can include causing a temporary or non-permanent change to one or more dimensions of the respective component(s).

Step 90A can include changing a temperature of at least one of the components of the assembly 60, such as the retention ring 66 and/or first component (e.g., support) 62 to meet a respective predetermined temperature threshold when the retention ring 66 is in a first (e.g., disassembly) position at step 90A-1. Step 90A-1 can include changing the temperature of only one, or more than one, of the components of the assembly 60, such as the first component 62 and/or retention ring 66. Step 90A-1 can include changing the temperature of the respective component(s) when the retention ring 66 is in the first position to establish an assembly clearance AC when the retention ring 66 is in a second (e.g., assembly) position relative to the first component 62, as illustrated by the retention ring 66" (shown in dashed lines for illustrative purposes). The assembly clearance AC can be established by the first diameter 73" or the second diameter 74" of the retention ring 66". In the illustrated example of FIG. 9, the assembly clearance AC is established between the second diameter 74" of the retention ring 66" and the diameter 70D of the first component 62 establishing the retention slot 70R.

Various techniques can be utilized to change the temperature of each respective component at step 90A-1. Step 90A-1 can include heating one or more components of the assembly 60 at step 90A-2 and/or cooling one or more of the components of the assembly 60 at step 90A-3. The heating at step 90A-1 can establish an expanded state of the respective component, such as one of the first component 62 and/or retention ring 66. The cooling at step 90A-1 can establish a contracted state of the respective component, such as another one of the first component 62 and/or retention ring 66.

Various techniques can be utilized to heat and/or cool the respective components of the assembly 60. Step 90A-2 can include positioning the first component 62 in a first environment ENV1 (shown in dashed lines for illustrative purposes) and then heating the first component 62 above a first predetermined temperature threshold to cause the retention slot 70R of the first component 62 to expand relative to the assembly axis AA. Various techniques can be utilized to perform the heating, such as wrapping the first component 62 in a heat blanket having heating coils. Step 90A-3 can include positioning the retention ring 66 in a second environment ENV2 (shown in dashed lines for illustrative purposes) and then cooling the retention ring 66 below a second predetermined threshold to cause the first diameter 73 and/or second diameter 74 of the retention ring 66 to contract relative to the assembly axis AA. Various techniques can be utilized to perform the cooling, such as positioning the retention ring 66 in a dry ice or nitrogen environment. The second predetermined threshold associated with the cooling in step 90A-3 can be less than the first predetermined threshold associated with the heating in step 90A-2. The first and/or second predetermined thresholds can be defined to establish the assembly clearance AC. The predetermined thresholds can be defined according to one or more dimensions, materials, stacking tolerances, etc., of the components of the assembly 60 in the cold assembly state. Each predetermined temperature threshold can be defined such that the predetermined temperature threshold is not met during operation of the engine 10, 20 in a hot assembly state.

At step 90B, one or more of the components prepared at step 90A are moved to respective assembly positions. Step 90B can include moving the second component 64 along the assembly axis AA such that the face 64FA second component 64 abuts against, or is otherwise adjacent to, the shoulder 70S of the first component 62. Step 90B can include moving the retention ring 66 along the assembly axis AA from the first position to the second position to establish the assembly clearance AC. Step 90B can occur such that the retention ring 66 is axially aligned with, but is spaced apart from, the retention slot 90R relative to the assembly axis AA, as illustrated by the retention ring 66" of FIG. 9. The retention slot 70R can be established along the first diameter 70D of the first component 62. The assembly clearance AC can be established between the outer diameter 660D of the retention ring 66 and the first diameter 70D of the first component 62. The first diameter 70D can be a radially inward facing surface of the first component 62 relative to the assembly axis AA.

Referring to FIG. 3, with continuing reference to FIGS. 8 and 9, at step 90C one or more of the components of the assembly 60 are secured to establish the cold assembly state. Step 90C can include securing the second component 64 and retention ring 66 relative to the first component 62. Step 90C can include securing the second component 64 with the retention ring 66.

Step 90C can include reducing the assembly clearance AC to establish the cold assembly state at step 90C-1. Step 90C-1 can include reducing the assembly clearance AC in response to the temperature of the component(s) prepared at step 90A no longer meeting the respective predetermined temperature threshold(s). Reducing the temperature can include applying an opposite or offsetting amount of heating or cooling to the respective component, or allowing the respective component to rest or normalize such that the component approaches the cold assembly state. Reducing the temperature can occur at a position outside of the respective environment ENV1/ENV2.

Reducing the assembly clearance AC can occur such that the second diameter 74 of the retention ring 66 is captured in the retention slot 70R. Step 90C-1 can occur such that the retention ring 66 expands or otherwise moves in a first direction D1 (FIG. 9) and into the retention slot 70R. Step 90C-1 can occur such that the first component 62 contracts or otherwise moves in a second direction D2 (FIG. 9) such that the retention ring 66 is captured in the retention slot 70R. The first direction D1 can be a radially outward direction relative to the assembly axis AA and the second direction D2 can be a radially inward direction relative to the radial direction R and/or assembly axis AA, or vice versa. The first and/or second directions D1, D2 can be substantially perpendicular or otherwise transverse to the assembly axis AA. The retention ring 66 can be dimensioned to establish an interference fit with walls of the retention slot 70R in the cold assembly state.

Reducing the assembly clearance AC can occur such that the second component 64 is trapped between the shoulder 70S of the first component 62 and the first circumferential face 75 of the retention ring 66. Reducing the assembly clearance AC can occur such that a respective clearance gap CG is established between the first component 62 and the floor 79F of the notch 79, as illustrated in FIGS. 3-4 and 6.

Referring to FIG. 6, with continuing reference to FIGS. 4 and 8, at step 90D one or more components such as the retention ring 66 can be removed from the assembly 60 to establish a disassembly state. Step 90D can including causing a permanent change to the respective component at step 90D-1, which can occur prior to and/or during the removal. Step 90D-1 can include at least partially or completely severing the retention ring 66 into one or more portions, as illustrated by the portions 66-1', 66-2' of the retention ring 66'. Severing the retention ring 66 can occur in response to moving the cutting tool TT into the clearance gap CG and then along the cutting path CP including along the first groove 80 to establish a pathway PP. In the implementation of FIG. 7, step 90D-1 can include moving the cutting tool TT along a cutting path CP intersecting both the first and second grooves 180, 181 to establish a pathway PP between the first and second grooves 180, 181 (shown in dashed lines for illustrative purposes).

Step 90D can include removing at least one portion (e.g., 66-1', 66-2') of the severed retention ring 66' from the retention slot 70R, and then removing the second component 64 from the first component 62, which can occur when the third component 68 is in an assembled position (FIG. 3). The cutting path CP can be substantially perpendicular or otherwise transverse to the assembly axis AA. In examples, step 90D-1 includes moving the cutting tool TT in a radially inward direction relative to the assembly axis AA.

The retention rings disclosed herein can be utilized to facilitate removal of component(s) retained in the assembly, while reducing a likelihood of degradation of the retained component(s). The disclosed retention rings can be dimensioned to establish a relative greater stiffness with a lower likelihood of liberation during engine operation.

It should be understood that relative positional terms such as "forward," "aft," "upper," "lower," "above," "below," and the like are with reference to the normal operational attitude of the vehicle and should not be considered otherwise limiting.

Although the different examples have the specific components shown in the illustrations, embodiments of this disclosure are not limited to those particular combinations. It is possible to use some of the components or features from one of the examples in combination with features or components from another one of the examples.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An assembly for a gas turbine engine comprising:

a support extending about an assembly axis and including a retention slot; and a retention ring received in the retention slot, the retention ring comprising:

a main body extending in a circumferential direction about the assembly axis to establish a continuous hoop having a first diameter and a second diameter, the main body including first and second circumferential faces along opposite sides of the main body that extend in a radial direction between the first and second diameters, and the first circumferential face is dimensioned to abut a gas turbine engine component;

wherein the main body includes at least one removal feature, the at least one removal feature includes a notch and a first groove, the notch extends in an axial direction along a face of the second diameter between the first and second circumferential faces, and the first groove extends in the radial direction from a floor of the notch along the first circumferential face to a face of the first diameter;

wherein the floor of the notch is radially offset from the retention slot relative to the longitudinal axis to establish a clearance gap, and the clearance gap is dimensioned to receive a cutting tool moveable along the first groove to sever the retention ring.

2. The assembly as recited in claim 1, wherein the at least one removal feature includes a plurality of removal features distributed about the assembly axis.

3. The assembly as recited in claim 1, wherein the first diameter is an inner diameter of the continuous hoop, and the second diameter is an outer diameter of the continuous hoop.

4. The assembly as recited in claim 1, wherein the at least one removal feature includes a second groove extending in the radial direction from the floor of the notch along the second circumferential face to the face of the second diameter.

5. The assembly as recited in claim 4, wherein the first groove is aligned with the second groove relative to the circumferential direction.

6. The assembly as recited in claim 1, wherein:

a first width of the first groove at the floor of the notch is less than a maximum width of the notch, the first width and the maximum width relative to the circumferential direction; and a first length of the first groove is greater than a maximum height of the notch, the first length and the maximum height relative to the radial direction.

7. The assembly as recited in claim 1, wherein the main body comprises a metallic material.

8. A gas turbine engine comprising:

a support extending about an engine longitudinal axis, the support including a shoulder and a retention slot;

a gas turbine engine component;

a retention ring received in the retention slot, wherein the retention ring includes a main body having a first diameter and a second diameter, the main body includes first and second circumferential faces along opposite sides of the main body, and the first circumferential face is dimensioned to abut the gas turbine engine component;

wherein the main body includes at least one removal feature, the at least one removal feature includes a notch and a first groove, the notch extends inwardly from a face of the second diameter that is received in the retention slot, and the first groove extends radially from a floor of the notch along the first circumferential face; and wherein the floor of the notch is radially offset from the retention slot relative to the engine longitudinal axis to establish a clearance gap, and the clearance gap is dimensioned to receive a cutting tool movable along the first groove to sever the retention ring.

9. The gas turbine engine as recited in claim 8, wherein the main body extends circumferentially about the engine longitudinal axis to establish a continuous hoop.

10. The gas turbine engine as recited in claim 8, wherein the first diameter is an inner diameter of the retention ring, the second diameter is an outer diameter of the retention ring, and the groove extends from the notch to the inner diameter of the retention ring.

11. The gas turbine engine as recited in claim 10, wherein the shoulder and the retention slot extend circumferentially about the engine longitudinal axis, the retention slot is radially outward of the shoulder, and the gas turbine engine component extends radially inward of the first circumferential face of the main body.

12. The gas turbine engine as recited in claim 8, wherein the at least one removal feature includes a plurality of removal features circumferentially distributed about an axis of the retention ring.

13. The gas turbine engine as recited in claim 8, wherein the gas turbine engine component is an annular seal dimensioned to engage a rotatable component.

14. A method of assembly for a gas turbine engine comprising:

changing a temperature of at least one of a retention ring and a support to meet a respective predetermined temperature threshold when the retention ring is in a first position to establish an assembly clearance when the retention ring is in a second position relative to the support, the assembly clearance established between a second diameter of the retention ring and a retention slot of the support;

wherein the retention ring includes a main body establishing a continuous hoop including a first diameter and the second diameter, the main body includes at least one removal feature having a notch and a first groove, the notch extends along the second diameter of the retention ring, and the first groove extends along a first circumferential face of the main body to the first diameter of the retention ring;

moving a gas turbine engine component along an assembly axis such that the gas turbine engine component is adjacent to a shoulder of the support;

moving the retention ring along the assembly axis from the first position to the second position to establish the assembly clearance such that the retention ring is axially aligned with, but is spaced apart from, the retention slot;

reducing the assembly clearance in response to the temperature no longer meeting the respective predetermined temperature threshold, wherein the reducing step occurs such that the second diameter of the retention ring is captured in the retention slot, such that the gas turbine engine component is trapped between the shoulder of the support and the first circumferential face of the retention ring, and such that a clearance gap is established between the support and a floor of the notch; and severing the retention ring in response to moving a cutting tool into the clearance gap and then along the first groove.

15. The method as recited in claim 14, wherein the at least one removal feature includes a plurality of removal features circumferentially distributed along the first circumferential face.

16. The method as recited in claim 14, further comprising:

removing at least one portion of the severed retention ring from the retention slot, and then removing the gas turbine engine component from the support.

17. The method as recited in claim 16, wherein:

a maximum height of the notch is greater than a maximum height of the retention slot at a common circumferential position relative to an engine longitudinal axis.

18. The method as recited in claim 16, wherein:

the at least one removal feature includes a second groove extending from the notch, the notch interconnects the first and second grooves, and the second groove extends along a second circumferential face of the retention body such that the second groove is circumferentially aligned with the first groove; and the severing step includes moving the cutting tool along a cutting path intersecting both the first and second grooves to establish a pathway between the first and second grooves.

19. The method as recited in claim 14, wherein the second diameter of the retention ring is an outer diameter, the retention slot is established along a radially inward facing surface of the support relative to the assembly axis, the assembly clearance is established between the outer diameter of the retention ring and the radially inward facing surface of the support, the respective predetermined temperature threshold includes a first predetermined temperature threshold associated with the support and a second predetermined temperature threshold associated with the retention ring, and the step of changing the temperature comprises:

heating the support above the first predetermined temperature threshold to cause the retention slot of the support to expand relative to the assembly axis; and cooling the retention ring below the second predetermined threshold to cause the outer diameter of the retention ring to contract relative to the assembly axis, the second predetermined threshold being less than the first predetermined threshold.

20. The method as recited in claim 14, wherein the support comprises a first metallic material, and the main body comprises a second metallic material.

* * * * *